United States Patent [19]

Scribner

[11] 4,310,114

[45] Jan. 12, 1982

[54] CONTROL ARRANGEMENT FOR DUAL SLIDE PNEUMATIC FEEDERS

[76] Inventor: Albert W. Scribner, 6 Country Club Rd., Darien, Conn. 06820

[21] Appl. No.: 116,548

[22] Filed: Jan. 29, 1980

[51] Int. Cl.[3] ..... B65H 17/36

[52] U.S. Cl. ..... 226/162; 226/115; 226/146

[58] Field of Search ..... 226/162, 167, 147, 146, 226/115, 150, 151, 159, 149

[56] References Cited

U.S. PATENT DOCUMENTS

| | | | |
|---|---|---|---|
| 3,038,645 | 6/1962 | Nordlot | 226/149 |
| 4,051,987 | 10/1977 | Scribner | 226/146 |
| 4,076,165 | 2/1978 | Scribner | 226/146 |
| 4,175,688 | 11/1979 | Scribner | 226/158 |
| 4,195,761 | 4/1980 | Scribner | 226/146 |

*Primary Examiner*—Edward J. McCarthy

[57] ABSTRACT

A pneumatic control arrangement for a high speed dual slide feeder for punch presses and the like; the feeder comprising two reciprocating feed slides which are respectively reciprocated by two main fluid motors and which respectively carry two gripper fluid motors. These four fluid motors are adapted to be sequentially controlled by only two control lines which arranged in a cross over type circuit and which have opposite pressure-exhaust conditions existing therein. This arrangement permits a substantial simplification in the valving and in the associated control lines over that normally required to produce the rapid successive alternate stock feed strokes of said feed slides; such thereby substantially reducing the cost of the feeder while increasing the reliability and durability thereof.

15 Claims, 5 Drawing Figures

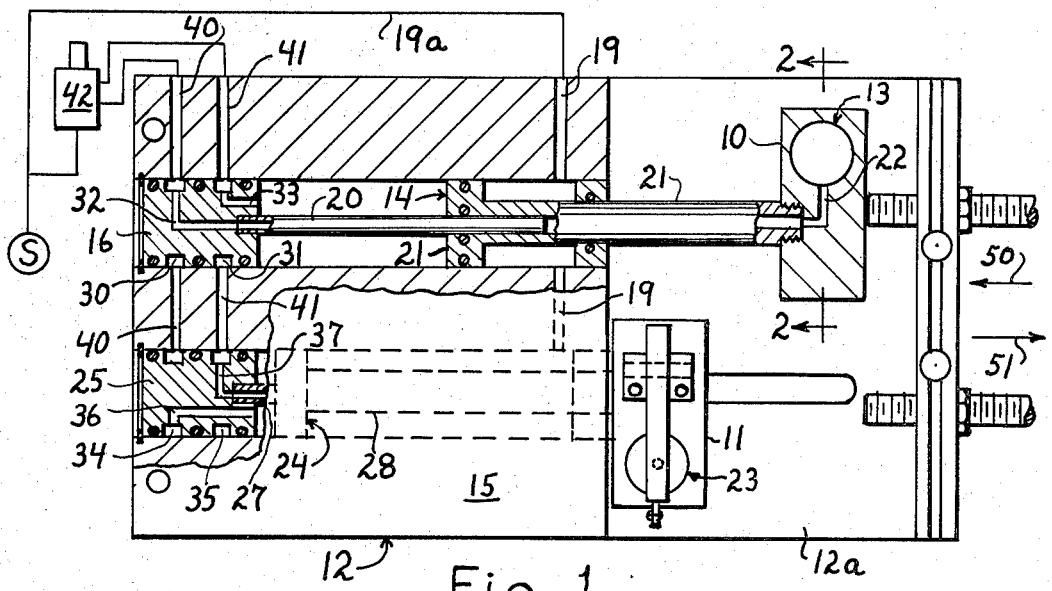
Fig. 1
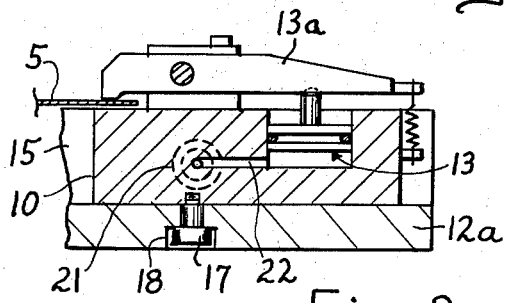
Fig. 2
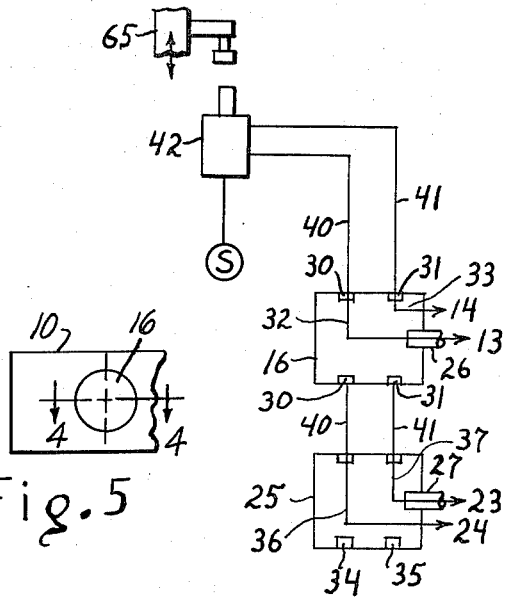
Fig. 3
Fig. 5
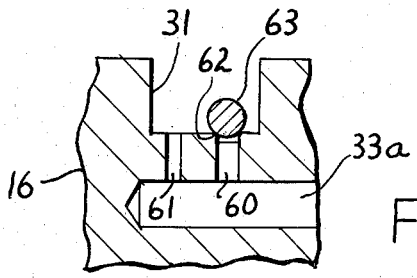
Fig. 4

CONTROL ARRANGEMENT FOR DUAL SLIDE PNEUMATIC FEEDERS

BACKGROUND OF THE INVENTION

Prior dual slide pneumatic feeders such as that illustrated in my prior U.S. Pat. Nos. 4,051,987 and 3,561,309 have employed four separate valving means and the many attendant internal and/or external fluid conduit lines to respectively service the four fluid motors of the feeder; for example the four motors illustrated at 20, 21, 22, 23 of said U.S. Pat. No. 4,051,987. This provision of a separate control line between each fluid motor and an associated valve connection has been operationally satisfactory but has involved considerable expense in the provision and servicing of the relatively large number of individual control elements.

SUMMARY OF THE INVENTION

The present invention seeks to simplify and reduce the cost of a dual slide pneumatic feeder by providing a fluid control system wherein only two instead of four control lines are required for sequentially controlling the four fluid motors of the feeder. More specifically here one control line services both the stock gripper motor carried by one feed slide and the main feed motor associated with the other feed slide, while the other control line services both the main feed motor associated with said one slide and the stock gripper motor carried by said other feed slide. By providing this cross-over type of control circuit a substantial reduction in the amount of pneumatic valving and related fluid conduit lines can be attained over that illustrated in the feeder disclosed in my said prior U.S. Pat. No. 4,051,987 thereby reducing costs and increasing reliability of the feeder.

The primary object of the present invention is to provide a novel construction and arrangement for the fluid flow conduit lines to the two main fluid motors and the two stock gripping fluid motors of a dual slide pneumatic stock feeder.

Another object of the invention is to provide a novel cross-over type circuit for controlling a pneumatically operated dual slide feeder.

A further object of the invention is to provide a novel speed control means for a feed slide of a pneumatic feeder.

Other objects of the invention will become apparent as the disclosure progresses.

BRIEF DESCRIPTION OF THE DRAWINGS

FIG. 1 is a plan view illustrating the construction and operation of the present dual slide feeder and the two-line control arrangement therefor.

FIG. 2 is a sectional view taken along section line 2—2 of FIG. 1.

FIG. 3 is a sketch diagrammatically illustrating the control system and circuit for the present feeder apparatus.

FIG. 4 is a sectional view taken along section line 4—4 of FIG. 5 and illustrates a modification for the main cylinder plugs.

FIG. 5 is a partial end view taken from the left of FIG. 1 and illustrates the plane where FIG. 4 is taken.

DETAILED DESCRIPTION OF THE INVENTION

Except as otherwise described herein the construction for the present dual slide feeder may be made similar to that described in said U.S. Pat. No. 4,051,987, the disclosure of said Patent being incorporated by reference herein.

The present feeder includes first and second feed slides 10 and 11 that are reciprocally mounted on the flat surface portion 12*a* of the U-shaped feeder frame 12. Slide 10 carries a pivoted stock gripping lever 13*a*, FIG. 2, that is adapted to be actuated by a single acting stock gripping fluid motor 13. Slide 10 is adapted to be reciprocally actuated by a first double acting main feed slide motor 14 carried by the main body portion 15 of the frame 12. The head end of motor 14 is closed by a generally cylindrically shaped plug 16 that is secured by any suitable means in the said main body portion of frame 12. Slide 10 is slidably retained for longitudinal reciprocating movement in feed and index directions 50 and 51 respectively on the flat surface portion 12*a* of the feeder frame 12 by means of a T-shaped retainer fastener 17, FIG. 2, that extends through a correspondingly T-shaped slot 18 that extends vertically through and longitudinally of said frame portion 12*a;* said fastener being secured at its upper end to the underneath portion of slide 10. Slide 11 is similarly slidably retained on frame portion 12*a*. The fluid conduit line to the fluid motor 13 on the slide 10 includes a tube 20 that is coaxially secured at one end thereof to the plug 16 and telescopically engages the tubular piston and piston rod 21 of the main fluid motor 14; the outer tubular end of said piston rod being threadedly coupled to said feed slide 10 and communicating with the fluid motor 13 through an air line 22 formed in the slide 10. The slide 11 carries a similar stock gripping fluid motor 23 and is adapted to be actuated by a second similar main fluid motor 24, the head end of the latter being closed by a similar plug 25. A corresponding fluid conduit line to the fluid motor 23 on slide 11 includes a similar tube 27 that is connected to said plug 25 and telescopically engages the piston and piston rod 28 of the main fluid motor 24. The rod ends of the main fluid motors 14 and 24 are each connected to a pressure source S so as to be continuously biased in a feed direction 50.

The two plugs 16 and 25 and the two main control lines coupled thereto will now be described in detail. Plug 16 is formed with two peripheral grooves 30 and 31 that are mutually pneumatically isolated by means of suitable O-ring seals. The left hand (as seen in FIG. 1) groove 30 communicates, through a line 32 formed in plug 16, with the adjacent end of said tube 20 and thus with stock gripping motor 13, while the right hand groove 31 communicates with the head end of the main fluid motor 14 through a relatively small cross-sectionally sized air line 33 also formed in plug 16. Plug 25 is formed with two similarly shaped and positioned mutually isolated peripheral grooves 34 and 35. Here the left hand (as seen in FIG. 1) groove 34 communicates with the head end of the main fluid motor 24 through a relatively small cross-sectionally sized air line 36 formed in plug 25, while the right hand groove 35 communicates through a line 37 formed in said plug 25 with the adjacent end of said tube 27 and thus with the stock gripping fluid motor 23. The relatively small sized lines 33 and 36 to the main feed motors 14 and 24 insure that each stock gripping and stock release action of the stock gripping levers is initiated prior to the initiation of the attendant initiation of operation of the main feed motors 14 and 24 as is well understood in the art. The main body portion 15 of the feeder frame is formed with two main control air lines 40 and 41; line 40 communicating with the left hand groove 30 of plug 16 and the left hand groove 34 of plug 25, while line 41 communicates with the right hand groove 31 of plug 16 and the right hand groove 35 of plug 25. The outer ends of control lines 40 and 41 are respectively coupled to a suitable valve means 42 which when in one operative condition thereof serves to pressurize line 40 with exhaust line 41, and when in a second operative condition thereof to exhaust line 40 and pressurize line 41. Valve means 42 may for example comprise merely the two output lines 190 and 192 as illustrated in FIG. 9 of said U.S. Pat. No. 4,051,987.

As will be seen when the control line 40 is pressurized and line 41 exhausted as occasioned by said valve means 42 being placed in a first operative condition in response to a first operational stroke of the punch press ram, the stock gripping motor 13 will be actuated to cause gripping of the stock by lever 13*a* and the main fluid motor 14 will be exhausted thereby producing a feed stroke of the feed slide 10 in the feed direction 50. These pressure conditions in lines 40, 41 will simultaneously cause the stock gripping motor 23 to be exhausted so as to release the stock and the head end of the main fluid motor 24 to be pressurized so as to thereby produce an index stroke of feed slide 11 in the non-feed or index direction 51. When the valve means 42 is shifted to a second operative condition in response to the next operative stroke of the press ram the pressure conditions in lines 40 and 41 will be reversed so that now the feed slide 10 partakes of the index stroke while feed slide 11 partakes of a feed stroke. As may be seen then the present simplified control system will cause the feed slides 10 and 11 to be alternately actuated so as to produce a rapid series of feed strokes in response to the successive operative strokes of the press ram.

It will be noted that the two air lines 32 and 33 formed plug 16 are interconnected between the grooves 30 and 31 thereof and the two associated fluid motors 13 and 23 in a manner that is effectively opposite to the interconnection of the two air lines 36 and 37 formed in plug 25 between the grooves 34 and 35 thereof and the two associated fluid motors 24 and 14 respectively; this structural arrangement affording a simple and relatively inexpensive way to implement the desired cross-over circuit connection between the straight parallel drilled portions of air lines 40 and 41 in the main body portion 15 and the four fluid motors.

The operation of the above described control system has been found to be very efficient in producing a rapid series of stock feed strokes of the feed slides 10 and 11.

If it is desired to increase the cycle and/or efficiency potential for the present feeder to an even higher level a simplified one way valve may be introduced into each of the air lines to the head ends of the main fluid motors 14 and 24. In that the modification for each plug 16 and 25 is the same a description of that for just the plug 16 will suffice here. Using only a single restricted line such as 33 above described the speed of the feed slide 10 tends to be slower for a feed stroke thereof than for an index stroke thereof. In order to approximately even up these speeds two parallel branches are established in the air line to the head end of the main motor 14 and a one way valve is operatively placed in one of said branches. To this end the plug 16 is modified as illustrated in FIG. 4 so that two holes or lines 60, 61 are formed so as to interconnect the plug groove 31 with the larger line 33*a* to the said head end of motor 14. A V-notch or groove 62 is peripherally formed in the bottom of the plug groove 31 and in the plane of line 60 and an O-ring 63 is disposed in said peripheral notch so as to permit fluid such as air to flow in a radially outward direction through line 60 but to prevent fluid flow in a radially inward direction through the line 60. In operation then both holes 60 and 61 will be available for exhausting air from the head end of fluid motor 14 but only hole 61 is available to conduct air to the head end of motor 14. This arrangement will make possible more uniformity between the operational feed and index speeds of slide 10 and this in turn will permit higher cyclic efficiency for the feeder.

If desired a flat faced rotary valve seat and rotor may be used herein of the type disclosed at 78 and 87 in my copending application Ser. No. 910,840 filed May 30, 1978 for Pneumatic Feeder for Punch Presses and the Like, now U.S. Pat. No. 4,195,761; the disclosure in said application being incorporated herein by reference.

I claim:

1. A dual slide pneumatically operated feeder for punch presses and the like; said feeder having a frame;

first and second feed slides reciprocally mounted on said frame;

stock gripping means carried by each of said feed slides;

a first fluid motor means carried by said first slide for actuating the stock gripping means carried by said first feed slide;

a second fluid motor means carried by said frame for reciprocally actuating said first feed slide;

a third fluid motor means carried by said second feed slide for actuating the stock gripping means carried by said second feed slide;

a fourth fluid motor means carried by said frame for reciprocally actuating said second feed slide; and control means for said first, second, third and fourth fluid motor means;

said control means comprising valve means adapted to be operated in response to the cyclic operation of said punch press and having two output control lines, one of said control lines being operatively coupled to said first and fourth fluid motor means and the other of said control lines being operatively coupled to said second and third fluid motor means;

said valve means being adapted when in one operative condition thereof to pressurize said one control line and to exhaust said other control line so as to cause said first slide to partake of a feed stroke and said second slide to partake of an index stroke, and adapted when in a second operative condition thereof to exhaust said one line and pressurize said other line so as to cause said second feed slide to partake of a feed stroke and said first feed slide to partake of an index stroke, whereby said feed slides may alternately produce a rapid series of stock feed strikes in response to the repeated operation of said valve means.

2. Apparatus as defined by claim 1 wherein said valve means comprises a single four way valve.

3. Apparatus as defined by claim 1 or 2 wherein said valve means comprises a rotary valve member.

4. Apparatus as defined by claim 1 or 2 wherein said second and fourth fluid motor means each includes a plug, each plug being formed with two correspondingly positioned inlet openings, two outlet openings and two air lines respectively interconnecting said inlet and outlet lines; the air line interconnections between inlets and outlets of one plug being effectively opposite to that for each other plug.

5. Apparatus as defined by claim 1 or 2 wherein said first and third fluid motor means are each single acting, and wherein each of said slides is slidably retained on said frame by a slot and retainer means disposed beneath the slide.

6. Apparatus as defined by claim 1 wherein two fluid conducting lines are provided for each main fluid motor, and wherein a one way valve is disposed in one of said fluid conducting lines.

7. Apparatus as defined by claim 6 wherein said one way valve includes an O-ring that is disposed in a peripheral groove.

8. A pneumatic feeder for intermittently advancing stock into the work station of a punch press or the like: comprising a frame;

feed slide means mounted for reciprocation on said frame;

stock gripping means carried by said feed slide means;

fluid motor means for actuating said feed slide means;

main valve means for controlling said fluid motor means;

fluid conduit means interconnecting said main valve means and said fluid motor means, a portion of said fluid conduit means defining two separate fluid flow paths;

auxiliary one-way valve means operatively disposed in one of said flow paths means and adapted to inhibit fluid flow in one direction through said one flow path and not to inhibit fluid flow in the opposite direction through said one flow path, said auxiliary one-way valve means including an O-ring type member that is disposed in a groove that is associated with said fluid motor means, at least a portion of said groove defining a portion of one of said flow paths.

9. Apparatus as defined by claim 8 wherein said feed slide means includes two alternately moving feed slides, wherein said fluid motor means includes two fluid motors, each of said fluid motors having a plug which is formed with air lines that define a pair of said flow paths and which has one of said auxiliary one-way valve means operatively disposed in one of its said paths, the last mentioned one-way valve means including a peripheral groove formed in said plug and an O-ring disposed in said plug groove.

10. A pneumatically operated feeder for intermittently advancing stock into the work station of a punch press or the like: comprising a frame;

first and second feed slides reciprocally mounted on said frame;

first and second fluid motor means for respectively reciprocally actuating said feed slides, each of said first and second fluid motor means including a main piston that is slidably disposed in an associated main cylinder, the two main cylinders being respectively closed at their head ends by means of two generally cylindrical plugs;

stock gripping means carried by each of said feed slides;

third and fourth fluid motor means for respectively actuating said stock gripping means between stock gripping and stock releasing positions;

valve means for controlling the operation of said first, second, third and fourth fluid motor means; and fluid conduit lines operatively disposed between said valve means and said four fluid motor means, the conduit lines from said valve means to said third and fourth fluid motor means including a pair of tubes, each of said tubes being secured at one end thereof to an associated one of said plugs and being telescopically received at the other end thereof in an associated one of said pistons respectively.

11. Apparatus as defined by claim 10 wherein each of said plugs is formed with first and second axially spaced peripheral grooves, the first groove of one plug and the second groove of the other plug forming portions of a first one of said conduit lines, while the second groove of said one plug and the first groove of said other plug form portions of a second one said conduit lines.

12. Apparatus as defined by claim 10 or 11 wherein said valve means comprises a single four-way valve having two output ports, wherein a first one said conduit lines operatively couples one output port of said four-way valve to the fluid motor means for actuating said first feed slide and to the fluid motor means which actuates the gripping means carried by said second feed slide, and wherein a second one of said conduit lines operatively couples the other output port of said four-way valve to the fluid motor means for actuating said second slide and to the fluid motor means which actuates the gripping means carried by said first feed slide.

13. Apparatus as defined by claim 10 or 11 wherein each of said plugs carries a check valve that is adapted to limit the speed of its associated feed slide in one direction of movement thereof.

14. Apparatus as defined by claim 13 wherein the movable valving element of each of said check valves comprises a flexible O-ring.

15. Apparatus as defined by claim 1 or 10 wherein said valve means comprises a valve seat and rotor having substantially flat mutually contacting and relatively sliding valving surfaces.

* * * * *